United States Patent [19]

Willis et al.

[11] Patent Number: 5,063,846

[45] Date of Patent: Nov. 12, 1991

[54] MODULAR, ELECTRONIC SAFE-ARM DEVICE

[75] Inventors: Kenneth E. Willis, Redwood City; Robert R. Durrell, Moss Beach, both of Calif.

[73] Assignee: Hughes Aircraft Company, Los Angeles, Calif.

[21] Appl. No.: 454,561

[22] Filed: Dec. 21, 1989

[51] Int. Cl.[5] ..... F23Q 7/22

[52] U.S. Cl. ..... 102/215; 102/218

[58] Field of Search ..... 102/215, 206, 218, 219, 102/220

[56] References Cited

U.S. PATENT DOCUMENTS

| | | | |
|---|---|---|---|
| 3,721,886 | 3/1973 | Phinney et al. | 102/219 |
| 4,137,850 | 2/1979 | Donner | 102/215 |
| 4,632,032 | 12/1986 | Miller | 102/206 |

FOREIGN PATENT DOCUMENTS

| | | | |
|---|---|---|---|
| 2169994 | 7/1986 | United Kingdom | 102/206 |

*Primary Examiner*—Deborah L. Kyle
*Assistant Examiner*—Stephen Johnson
*Attorney, Agent, or Firm*—R. M. Heald; C. D. Brown; W. K. Denson-Low

[57] ABSTRACT

A modular electronic safe arm device (MESAD) (10) for arming and igniting an explosive is universal in application and employs a standard circuit architecture which uses application specific logic modules (12) and (14), a standard voltage control module (16), and standard high energy firing modules (18) and (20). In the preferred embodiment, the logic modules (12) and (14) are state machines using clocked sequential logic and having read-only-memories. The logic modules (12) and (14) generate dynamic arming signals at outputs (54) and (76) which cause the voltage control module (16) in conjunction with transformer (102), to convert a low voltage input (98) to a high voltage output (100). The high voltage output (100) is used to charge firing capacitors (112) and (138) in standard high energy firing modules (18) and (20). Logic module (14) generates two trigger signals at outputs (76) and (78) for activating the trigger modules (126) and (148). Charging and triggering of the high energy firing modules (18) and (20) causes explosive foil initiators (108) and (134) to ignite the explosive. Application specific interface units (40) and (86) allow the MESAD (10) to be used in many different applications.

15 Claims, 3 Drawing Sheets

WEAPON
PRIMARY EXPLOSIVE
TRIGGER MODULE
TRIGGER MODULE
A
18
20
78
80
108
110
112
116
116
118
118
124
126
134
136
138
146
148
154
155
156
157

MODULAR, ELECTRONIC SAFE-ARM DEVICE

BACKGROUND OF THE INVENTION

1. Technical Field

The present invention relates to arming devices for weapons and more specifically to a modular electronic safe arm device.

2. Discussion

Explosive warheads used in missiles, bombs add projectiles utilize a safe arm device which prevents the inadvertent explosion of the warhead. Rocket motors often use a similar device to prevent inadvertent ignition of the rocket propellant. These devices vary widely in their design and implementation but share two common characteristics. They use external signals or internal sensors to establish an "arming environment"; that is, they arm only when the weapon has been intentionally launched for a lethal mission. Secondly, they provide a mechanical block of the explosive train separating devices which contain sensitive primary explosives from the less sensitive secondary explosives contained in boosters and warheads.

Recent explosive technology has made it possible to directly initiate secondary explosives with short, high voltage, high current pulses of electricity. These initiation devices are called "exploding foil initiators" (EFI). Since these EFIs contain only insensitive secondary explosives, they make it possible to build an all electronic safe arm device by eliminating the mechanical block separating the sensitive primary explosive. The safeing function is performed by an electronic circuit that prevents the charging of a high voltage firing capacitor which is essential to the function of the EFI. As long as no charge is present on the firing capacitor, the electronic safe arm device remains safe and cannot initiate an explosive or propellant.

In recent years, several electronic safe arms have been designed for use in missiles and bombs. These devices have been adapted to particular applications and have contained electronic circuits typically containing a microcomputer to sense arming environments and when a safe separation environment has been established to charge the high voltage firing capacitor, thus arming the EFI. While these electronic safe arms have certain common characteristics, they have been implemented with different circuits and different physical configurations to suit the specific application.

SUMMARY OF THE INVENTION

In accordance with the teachings of the present invention, a universal apparatus for arming and igniting an explosive, such as a warhead, is provided. The apparatus includes a standard circuit architecture which has an application specific logic module, having a read-only-memory (ROM), which generates arming signals and triggering signals when internal time input signals and external sensor input signals combine to produce a ROM address equal to a preset code. A voltage control module, together with a transformer, converts a low voltage signal from the logic unit to a high voltage signal necessary for charging a firing capacitor in a high energy firing module (HEFM). The HEFM employs a trigger module to discharge the capacitor and ignite a secondary explosive. The apparatus is modular in construction, being capable of employment in a variety of applications. An interface adapts the apparatus for use in particular applications.

BRIEF DESCRIPTION OF THE DRAWINGS

Other objects and advantages of the invention will become apparent upon reading the following detailed description and upon reference to the drawings in which.

DESCRIPTION OF THE PREFERRED EMBODIMENTS

Figure 1A:
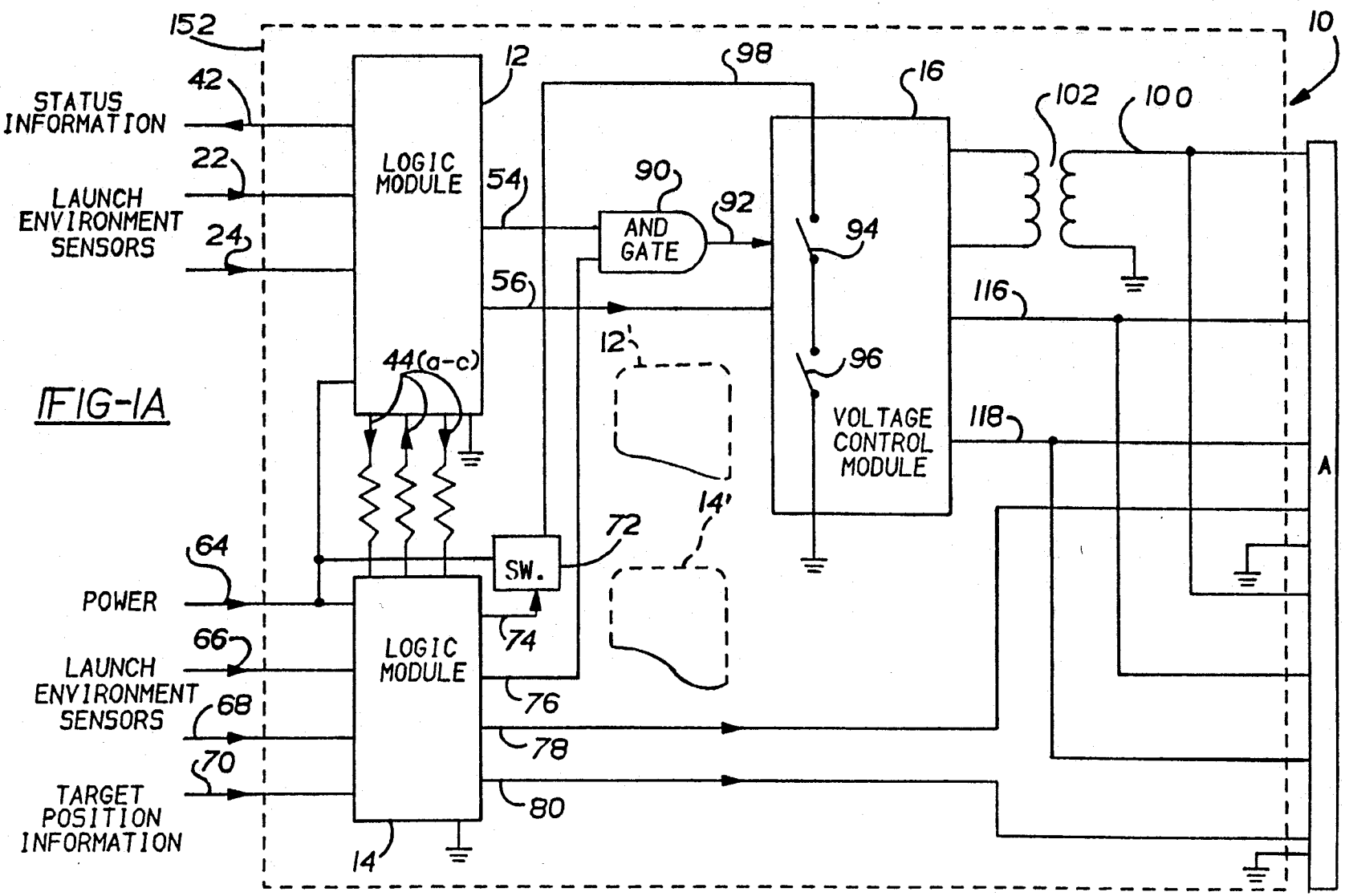
FIGS. 1A and 1B are block diagrams of the modular electronic safe arm device.
Figure 1B:
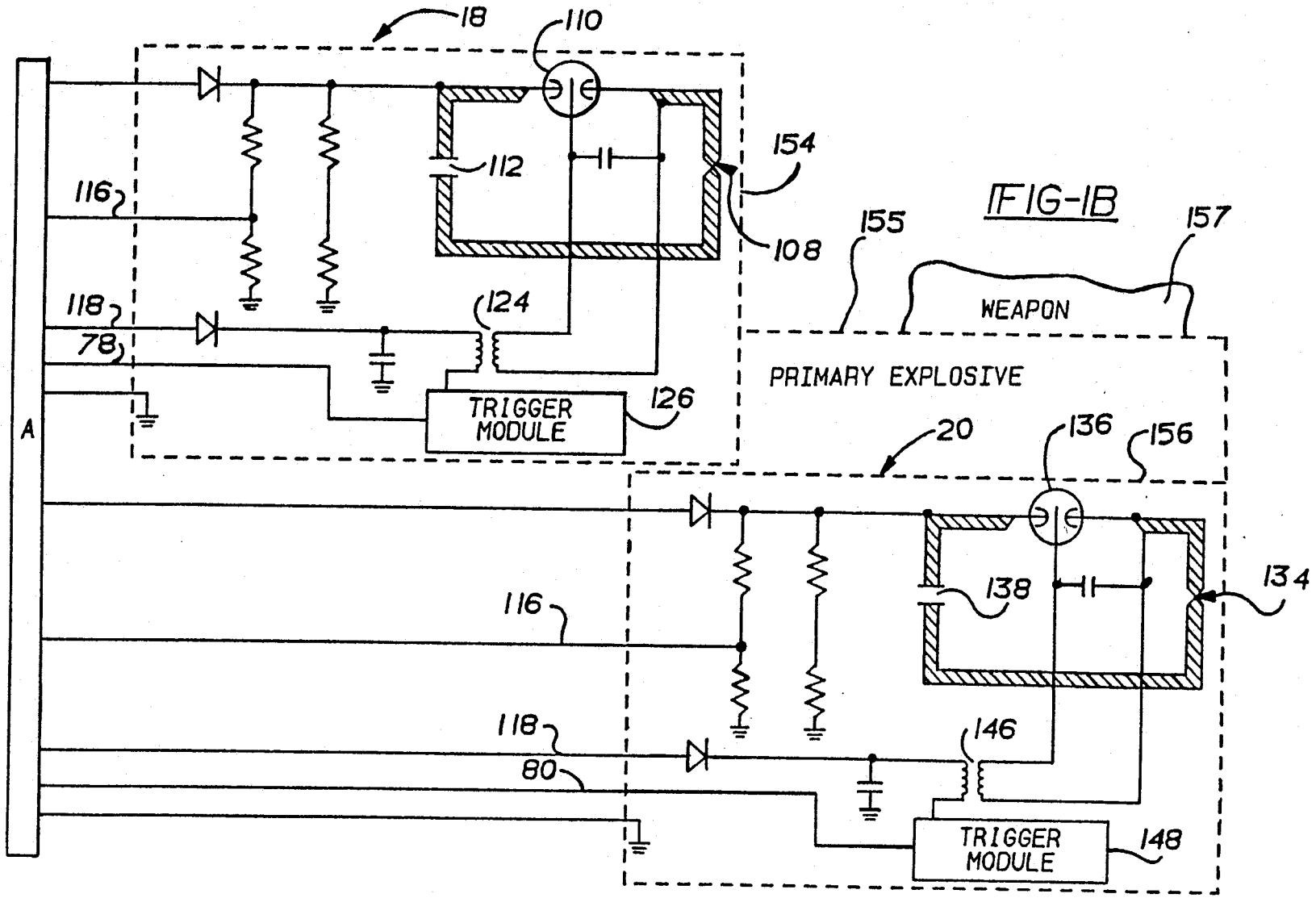

There is shown in FIGS. 1A and 1B a standard circuit architecture of a modular electronic safe arm device (MESAD) 10 which employs logic modules 12 and 14, a voltage conversion module 16, and high energy firing modules (HEFM) 18 and 20. It is possible to build most, if not all, electronic safe arm devices, better known as electronic safe arms (ESA), with this circuit architecture and with these common modules.

In the preferred embodiment, the logic modules 12 and 14 are state machines employing clocked sequential logic and having read only memories (ROM). A microprocessor could be substituted for each of the state machines; however, state machines are preferred because they limit flexibility in order to maximize the safety and reliability of the weapon. Unlike a microprocessor, a state machine is application specific, because of its preset code. Once the proper codes for initiating the firing sequence are preset into the ROM, they cannot be inadvertently changed. Two state machines are used instead of one to enhance safety. The logic module 14 provides a redundant check on the validity of the arming environment; if the first logic module 12 should fail, the second logic module 14 would block arming. The second logic module 14 contains its own safeing switch 72 to prevent inadvertent arming even if the other modules should fail.

The logic module 12 has external input terminals 22 and 24, which provide information from launch environment sensors. These sensors may be located internal or external to the MESAD 10, an application specific interface means may be required to couple some of these sensors to the logic module 12.

The logic module 12 has input/output terminals 42, 44(*a–c*), 54, and 56. Output 54 provides the dynamic arming signal to drive the voltage control module 16. Outputs 44(*a–c*) are logic interfaces for test and cross-check between logic modules 12 and 14. The output 56 closes the lower static switch 96. Finally, output 42 provides status data to the controller of the weapon.

The state machines employ a classical electronic circuit architecture built around a clocked look-up table (LUT) within the ROM. Part of each next LUT address is determined by the external inputs 22 and 24 and part by the data output value of the LUT. The ROM address is made up from a time counter value plus a set of values associated with external event inputs plus several state feedback inputs. The ROM data output controls the warhead arming functions. A dynamic signal from output 54 can only be generated if the correct external inputs occur at the correct time as determined by the code which is preset into the ROM. Other ROM data outputs provide control bits, such as the static signal at output 56 and the trigger signals at outputs 78 and 80 of logic module 14, provide state feedback to the ROM address inputs, and control the state machine time counter. The dynamic arming signal is produced by an arming frequency generator when the ROM address equals the preset code.

In the preferred embodiment, the logic module 14 is also a state machine for the same reasons as logic module 12. It has external inputs 64, 66, 68, and 70. Input 64 provides power, properly conditioned, to operate the MESAD (10). Input 66 and 68 provide launch information from a second set of sensors, which may be located internal or external to the MESAD 10. Finally, input 70 provides target position information from a target detection device, such as a radar system. A second interface means may be required to couple some of these sensors to the logic module 14.

Logic module 14 has outputs 74, 76, 78, and 80. Output 74 closes an upper static switch 72, which allows power to flow to the voltage control module 16 through input 98. Output 76 provides a dynamic arming signal to the AND gate 90. Outputs 78 and 80 provide triggering signals which initiate the explosive output from HEFM 18 and 20.

The outputs 54 and 76 are combined using AND gate 90. If outputs 54 and 76 occur at a single moment of time, then AND gate 90 generates an output 92 in the form of pulse to the voltage control module 16 where it activates the dynamic switch 94. The output 56 is a static signal, also in the form of a pulse and generated by the arming frequency generator, which controls the lower static switch 96.

The voltage control module 16 is a standard module employing a DC-to-DC converter which, in conjunction with transformer 102, converts low voltage power at input 98 to high voltage power for use by the high energy firing modules (HEFM) 18 and 20. Furthermore, it regulates the voltage across the firing capacitors 112 and 138. The dynamic signal input 92 drives the voltage conversion and must be continuously supplied by the logic modules 12 and 14, thereby enhancing safety. The voltage control module 16 also provides energy to the trigger modules 126 and 148 to enable them to discharge the triggers 110 and 136. The triggers 110 and 136 are standard vacuum gap switches.

The voltage control module 16 must be coupled to at least one high energy firing module. In the preferred embodiment, two high energy firing modules 18 and 20 are connected in parallel to increase the probability that the explosive will detonate when desired. The HEFMs 18 and 20 are triggered separately by the outputs 78 and 80 of logic unit 14 to enhance reliability or initiate separate charges at different times. The output signal 100 of transformer 102 is coupled to the HEFM 18 and 20 through cables. The high voltage signal is used to charge the firing capacitors 112 and 138. Output 116 is used to sense the voltage on firing capacitor 112 so the voltage control module 16 can maintain a constant voltage. Output 118 supplies energy to the trigger modules 126 and 148.

HEFM 18 and 20 are standard modules, containing exploding foil initiators (EFI) 108 and 134, the high voltage firing capacitors 112 and 138, and trigger modules 126 and 148. The EFI is a standard explosive device that functions when short duration high current pulses of current are applied. The trigger modules 126 and 148 generate short, rapid rise time pulses to trigger the transformers 124 and 146 which increase the voltage of the pulses so the vacuum gap switches 110 and 136 can conduct energy from the firing capacitors 112 and 138 to the EFIs 108 and 134.

The HEFM 18 and 20 are contained in housings 154 and 156, separate from housing 152 to facilitate installations adjacent primary explosives 155 in weapon 157 having insufficient space to contain a single large housing. All housings are grounded to each other and to the external power supply.

The advantages associated with employing standard modular components are many. Different weapons can be detonated by merely substituting different logic modules 12' and 14' which are particularly associated with the different weapon. Since the standard modules and circuits can be used in other applications, less money may be spent on the development of new designs to fit new applications. Significant economies of scale can be achieved by using modules that can be mass produced. The modular approach provides proven reliability since a large number of identical devices are observed rather than lower numbers of dissimilar devices. Safety is improved because the common modules can be more intensively analyzed and tested when supporting multiple applications. Finally, less time is required to develop and qualify other electronic safe arms, thereby allowing more rapid deployment of these critical defense items.

Figure 2:
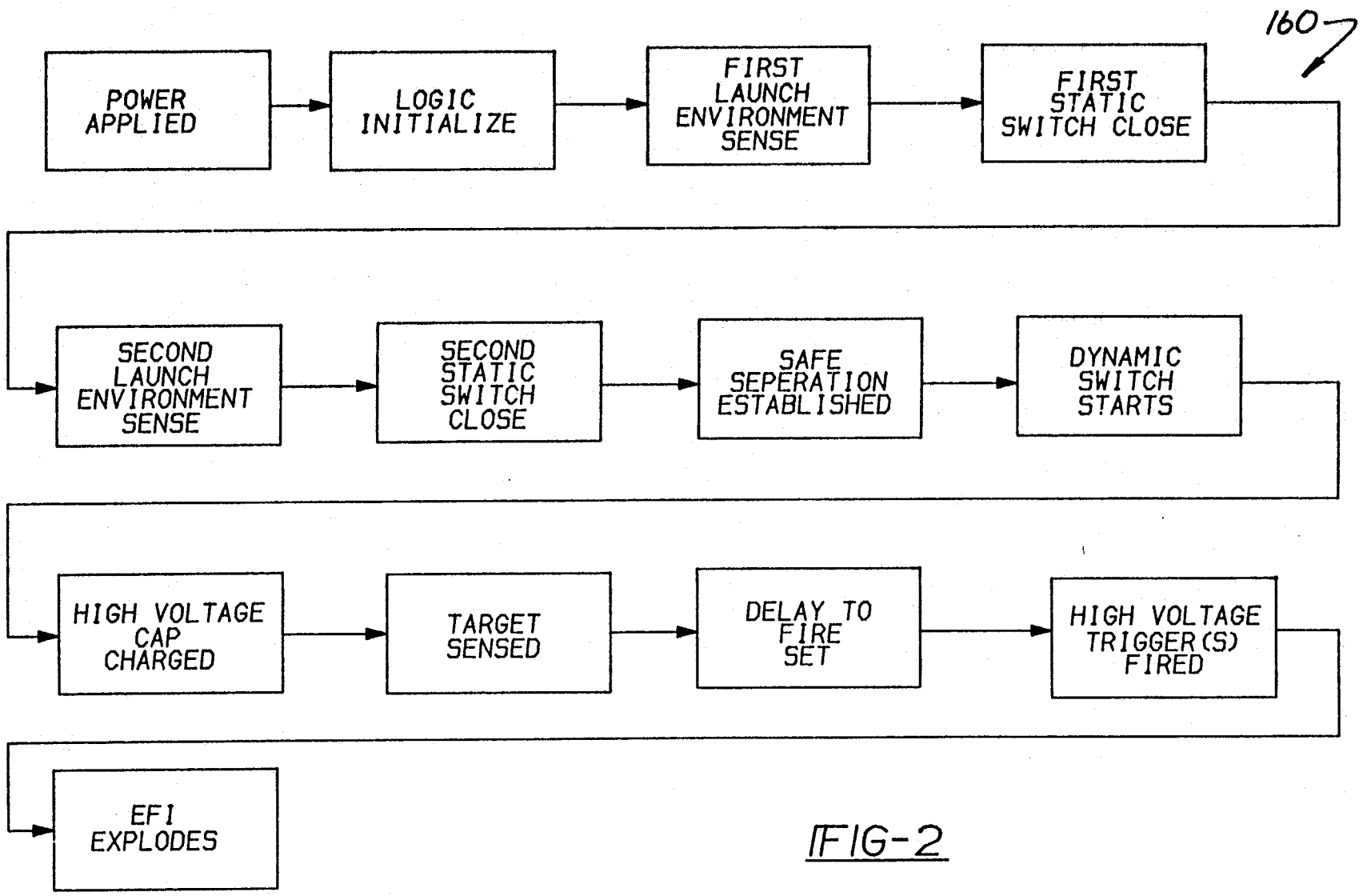
FIG. 2 is a flow diagram teaching the description of the preferred embodiment.

A block diagram 160 of the events leading up to an explosion is illustrated in FIG. 2. The first step is to apply power, which starts initialization of the logic. Launch environment sensors for logic module 12 send information to that module, which then generates output 56 to close static switch 96. Launch environment sensors for logic module 14 send information to that module, which then generates output 74 to close upper static switch 72. Other sensors establish a safe separation from the controller, after which time the ROM address equals the preset code. Both logic modules 12 and 14 generate dynamic arming signals at outputs 54 and 76, which close dynamic arming switch 94, thereby applying power to the voltage control module 16. The firing capacitors 112 and 138 are charged, the target is sensed, and the delay for firing is computed by logic module 14. At the end of the delay period, the high voltage triggers 110 and 136 are fired by trigger modules 126 and 148, thereby exploding the EFIs.

Although the invention has been described with particular reference to certain preferred embodiments thereof, variations and modifications can be effected within the spirit and scope of the following claims. For example, these modules can be implemented in a variety of processes, including but not limited to thick film hybrid surface mounted electronics, discrete components with printed circuit boards, or other advanced electronic integration processes.

What is claimed is:

1. A universal apparatus for igniting a primary explosive, said apparatus comprising:

(a) at least one standard firing means for igniting said primary explosive upon receipt of both a high voltage output signal and a trigger signal;

(b) a standard voltage control means for generating said high voltage output signal in response to an arming signal; and (c) first application specific logic means for generating said arming signal so that the voltage control means can generate the high voltage signal for arming the firing means and, thereafter, for generating said trigger signal to ignite the primary explosive;

whereby the apparatus can be sued to detonate different devices by replacing said application specific logic means with a different application specific logic means particularly associated with the device to be detonated.

2. The apparatus of claim 1 further comprising at least one interface means for coupling said logic means to a control means remotely located form the primary explosive for providing control signals to the logic means for controlling the arming of said firing means.

3. The apparatus of claim 2, further comprising a second logic means for generating a second set of arming signals and triggering signals; and gate means for receiving said arming signals from the first and second logic means and providing power to said voltage control means in response to substantially simultaneous occurrence of arming signals from both logic means.

4. The apparatus of claim 3 further comprising: a plurality of housing means, one housing means containing said first and second logic means, said voltage control means, and said interface means, another housing means containing said firing means, and means for removably coupling said voltage control means in said one housing to the firing means in said another housing.

5. The apparatus of claim 1 wherein said logic means is a state machine, having a read-only-memory.

6. The apparatus of claim 1 wherein said logic means is a microprocessor.

7. The apparatus of claim 2 wherein said voltage control means is a DC-to-DC converter, having a plurality of safety switches controlled by said arming signals from said first and second logic means.

8. The apparatus of claim 3 wherein said firing means comprises:

(a) a secondary explosive for igniting said primary explosive;

(b) capacitive means in proximity with said secondary explosive for storing the high voltage output from said voltage control means; and (c) triggering means for causing said capacitive means to discharge, thereby igniting the secondary explosive.

9. The apparatus of claim 8 wherein said firing means includes an exploding foil initiator.

10. The apparatus of claim 2 wherein said interface means comprises a standard RS422 serial interface.

11. The apparatus of claim 1 wherein said at least one firing means is comprised of a plurality of firing means.

12. A universal apparatus for arming and igniting a primary explosive, said apparatus comprising:

(a) firing means, including two standard exploding foil initiators, for igniting said primary explosive upon receipt of both a high voltage output signal and a trigger signal;

(b) a standard DC-to-DC converter for generating said high voltage output signal in response to an arming signal;

(c) two application specific logic means for generating arming signals so that the DC-to-DC converter can generate the high voltage signal for arming the exploding foil initiators and, thereafter, for generating said trigger signal to ignite the primary explosive;

(d) application specific interface means for coupling said logic means to a control means remotely located from the primary explosive for providing control signals to the logic means for controlling the arming of said exploding foil initiators;

(e) standard AND gate means for receiving said arming signals from said two logic means and enabling said DC-to-DC converter in response to substantially simultaneous occurrence of selected signals form said two logic means;

(f) three standard housing means, the first housing means containing said logic means, said DC-to-DC converter, and said interface means, the second housing means containing one of said exploding foil initiators, and the third housing means containing the other exploding foil initiator; and (g) means for removably coupling said DC-to-DC converter in said first housing to each exploding foil initiator in the other housings;

whereby the apparatus can be used to detonate different devices by replacing said application specific logic means with another application specific logic means particularly associated with the device desired to be detonated.

13. The apparatus of claim 12 wherein said logic means is a state machine.

14. A method for detonating a wide variety of weapons, said method comprising:

(a) fabricating a plurality of electronic safe arm (ESA) circuit modules, each module having standard components and application specific components, said standard components including at least one standard firing means for igniting a weapon upon receipt of both a high voltage output signal and a trigger signal, and a standard voltage control means for generating said high voltage output signal in response to an arming signal; said application specific components including at least one first application specific logic means for generating said arming signal so that the voltage control means can generate the high voltage signal for arming the firing means and, thereafter, for generating said trigger signal to ignite said weapon;

(b) installing one ESA circuit module in one device by locating the firing means in proximity with the weapon, and by coupling the application specific logic means to an external control means remotely located for the weapon for providing control signals to the logic means;

(c) providing a second ESA circuit module by using the standard components and replacing the first application specific logic means with a second application specific logic means; and (d) installing the second ESA circuit module in another weapon;

whereby the circuit modules can be used to detonate different weapons by replacing said application specific logic means with other application specific log is means particularly associated with the weapon desired to be detonated.

15. The method of claim 14 wherein said step of installing said one ESA circuit module in one device by coupling the first application specific logic module to an external control means is carried out by coupling an application specific interface means to said one ESA circuit module.

* * * * *

UNITED STATES PATENT AND TRADEMARK OFFICE

CERTIFICATE OF CORRECTION

PATENT NO. : 5,063,846

DATED : Nov. 12, 1991

INVENTOR(S) : Kenneth E. Willis and Robert R. Durrell

It is certified that error appears in the above-identified patent and that said Letters Patent is hereby corrected as shown below:

Column 5, line 3, instead of the word "sued" insert --used--
by Amendment filed 2-7-91, page 3, line 1.

Column 6, line 8, instead of the word "form" insert --from--
by Amendment filed 2-7-91, page 4, line 28.

Signed and Sealed this

Sixth Day of April, 1993

*Attest:*

STEPHEN G. KUNIN

*Attesting Officer*

*Acting Commissioner of Patents and Trademarks*